US012083650B2

(12) United States Patent
Grove

(10) Patent No.: US 12,083,650 B2
(45) Date of Patent: Sep. 10, 2024

(54) OUTER DIAMETER CLEANING AND SANDING DRILL ATTACHMENT

(71) Applicant: Lawrence W. Grove, Erie, PA (US)

(72) Inventor: Lawrence W. Grove, Erie, PA (US)

( * ) Notice: Subject to any disclaimer, the term of this patent is extended or adjusted under 35 U.S.C. 154(b) by 546 days.

(21) Appl. No.: 17/287,513

(22) PCT Filed: Oct. 22, 2019

(86) PCT No.: PCT/US2019/057417

§ 371 (c)(1),
(2) Date: Apr. 21, 2021

(87) PCT Pub. No.: WO2020/086565

PCT Pub. Date: Apr. 30, 2020

(65) Prior Publication Data

US 2021/0387302 A1 Dec. 16, 2021

Related U.S. Application Data

(60) Provisional application No. 62/748,930, filed on Oct. 22, 2018.

(51) Int. Cl.

| | |
|---|---|
| ***B24B 9/00*** | (2006.01) |
| ***B24B 23/02*** | (2006.01) |
| ***B24D 7/02*** | (2006.01) |

(52) U.S. Cl.

CPC ..... *B24B 9/007* (2013.01); *B24B 23/02* (2013.01); *B24D 7/02* (2013.01)

(58) Field of Classification Search

CPC ..... B24B 23/02; B24B 23/00; B24B 23/08; A46B 13/00; A46B 13/001

See application file for complete search history.

(56) References Cited

U.S. PATENT DOCUMENTS 2,225,272 A 12/1940 Horne
3,188,674 A * 6/1965 Hobbs ..... B08B 9/021 15/160

(Continued)

OTHER PUBLICATIONS

Dremel. Dremel 432 1/2-Inch 120 Grit Sanding Bands, 6 Pack. Power & Hand Tools on amazon.com. Jun. 27, 2017 (Jun. 27, 2017) [retrieved on Nov. 26, 2019]. Retrieved from the internet <URL: https://www.amazon.com/Dremel-432-2-Inch-Sanding-Bands/dp/B00004UDHF> entire document.

*Primary Examiner* — Lee D Wilson

(74) *Attorney, Agent, or Firm* — Jonathan M. D'Silva; MMI Intellectual Property

(57) ABSTRACT

An attachment for a drill comprises a shank with a chuck configured to mount the attachment to the drill. A housing on the shank comprises a threaded end and a hollow chamber. A compression bladder having a tubular opening through it is configured to be inserted into the hollow chamber. A tube comprising a sanding or cleaning surface located on the inner surface of the tube is configured to be insertable into the tubular opening of the compression bladder. A threaded lid having a circular opening that is at least the same diameter as the inner diameter of the tube is configured to mount onto the housing at the threaded end and compress the compression bladder thereby reducing the diameter of the tubular opening and compressing the compression bladder against the tube to secure the tube within the housing.

9 Claims, 3 Drawing Sheets

(56) References Cited

U.S. PATENT DOCUMENTS 3,568,376 A 3/1971 Slater
4,862,549 A 9/1989 Criswell et al.
4,887,508 A 12/1989 Bianco
5,038,525 A 8/1991 Gardner
5,167,527 A 12/1992 Clark
5,168,660 A 12/1992 Smith
5,419,087 A 5/1995 Haddy
5,564,972 A 10/1996 Marvin et al.
5,566,416 A 10/1996 Karls
5,791,005 A 8/1998 Grabowski et al.
6,152,814 A * 11/2000 Amarosa, Sr. ..... B24D 9/02 451/526
6,553,601 B1 4/2003 Major
6,561,888 B2 5/2003 Domanksi et al.
6,802,765 B1 * 10/2004 Torrez ..... F02F 7/0046 451/344
6,983,508 B2 1/2006 Saurer
7,413,505 B1 8/2008 Rowlen, Jr.
8,032,970 B2 * 10/2011 Chen ..... A46B 13/001 15/160
8,613,642 B2 12/2013 Bowles et al.
9,216,439 B2 * 12/2015 Le Blanc ..... A46B 13/02
2004/0031112 A1 * 2/2004 Saurer ..... B08B 9/057 15/4
2006/0030827 A1 2/2006 Raulerson et al.
2006/0112506 A1 6/2006 Smart et al.
2006/0289025 A1 12/2006 Nevakshonoff
2009/0235470 A1 9/2009 Moisides
2010/0263145 A1 * 10/2010 Chen ..... A46B 5/0095 15/160
2011/0005012 A1 * 1/2011 Le Blanc ..... B08B 1/04 15/21.1
2012/0186032 A1 * 7/2012 Donohue ..... B08B 1/002 15/93.1
2015/0004881 A1 1/2015 Campbell
2015/0183075 A1 7/2015 Huang et al.
2018/0256879 A1 9/2018 Chiu et al.
2021/0387302 A1 * 12/2021 Grove ..... B24B 23/02

* cited by examiner

OUTER DIAMETER CLEANING AND SANDING DRILL ATTACHMENT

BACKGROUND

There is a need to sand the outer diameter of the end of pipes, fittings, and other tubes. This is done to ensure better insertion of parts or for the better adhesion of glue, or other such purpose. Sometimes the ends of pipe may just have to be cleaned. This is done primarily by hand as prior art mechanical means to sand or clean the outer diameter of a pipes are complicated and bulky. What is presented is an attachment that can be mounted to a standard drill for sanding and/or cleaning the outer diameter of pipes and other tubes.

SUMMARY

What is presented is an attachment for a drill that comprises a shank with a chuck configured to mount the attachment to the drill. A housing on the shank comprises a threaded end and a hollow chamber. A compression bladder having a tubular opening through it is configured to be inserted into the hollow chamber. A tube comprising a sanding or cleaning surface located on the inner surface of the tube is configured to be insertable into the tubular opening of the compression bladder. A threaded lid having a circular opening that is at least the same diameter as the inner diameter of the tube is configured to mount onto the housing at the threaded end and compress the compression bladder thereby reducing the diameter of the tubular opening and compressing the compression bladder against the tube to secure the tube within the housing.

The compression bladder is an elastomeric material but can be any compressible material. The tube is made of paper, plastic, or metal and the sanding or cleaning surface comprises one of emery cloth, sandpaper, glass paper, or other cleaning or abrasion system.

The tube has an inner diameter to match the range of pipe outer diameters that are to be sanded or cleaned but typically the tube would be in the range of ¼-inch to 5-inches for small handheld drills but could be made of larger sizes for commercial and industrial applications. The circular opening of the attachment limits the size of pipe that may be sanded or cleaned by the attachment, but it would typically have a diameter of in the range of ¼-inch to 5-inches for small handheld drills but could be made of larger sizes for commercial and industrial applications.

In some embodiments, the compression bladder could comprise a series of compression bladders that extend through the hollow chamber. In this instance one or more of the compression bladders could be replaced by a non-compressible ring. The lid could also be modified to have a non-compressible ring mounted between the lid and the compression bladder. This non-compressible ring could be formed into the lid, attached to the lid, or free floating between the lid and the compression bladder.

Those skilled in the art will realize that this invention is capable of embodiments that are different from those shown and that details of the apparatus and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
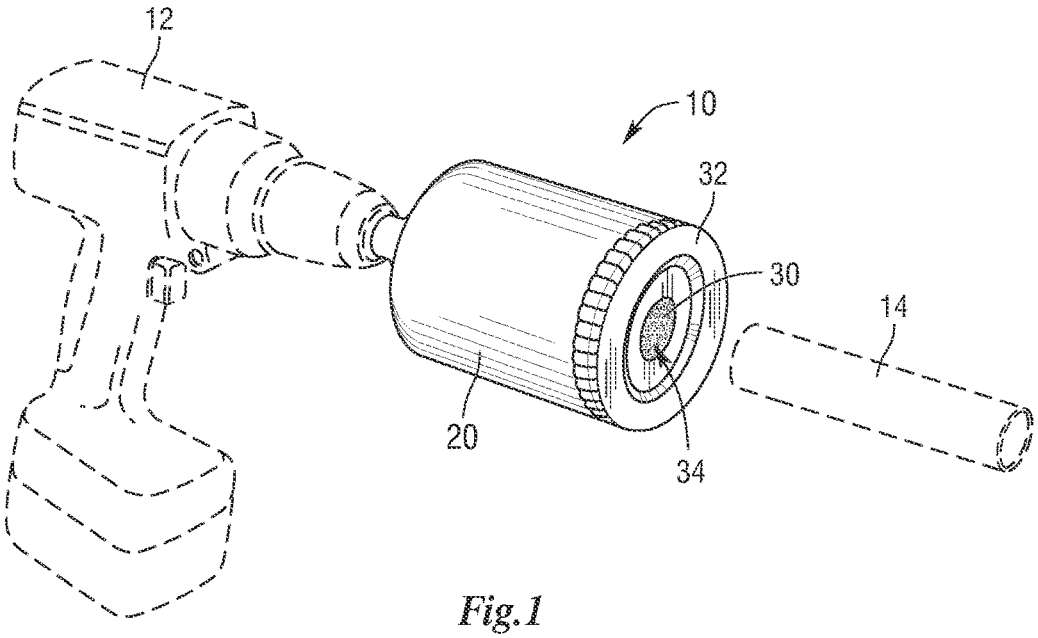
FIG. 1 is a perspective view of an outer diameter cleaning and sanding drill attachment mounted to a drill indicating a pipe about to be inserted into the attachment for sanding or cleaning.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

Figure 2:
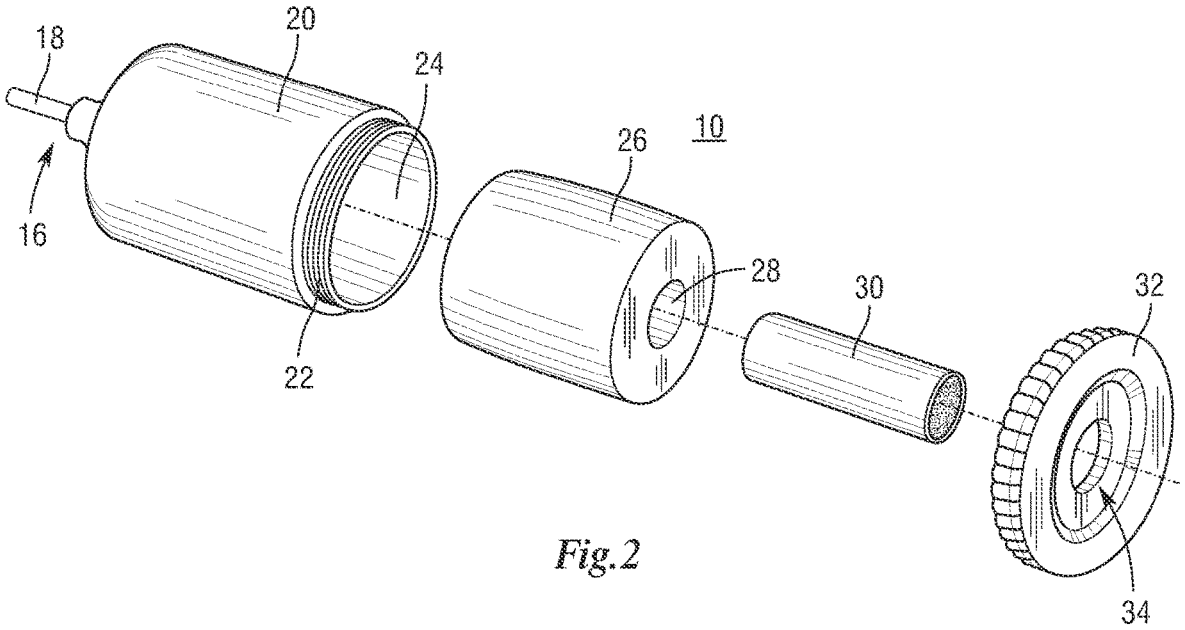
FIG. 2 is an exploded view of the outer diameter cleaning and sanding drill attachment shown in FIG. 1.

As best understood by comparing FIGS. 1 and 2, what is presented is an attachment 10 for a drill 12 that can be used to sand or clean the outer diameter of a pipe 14 that is inserted into the attachment 10. The attachment 10 comprises a shank 16 with a chuck 18 that is configured to mount the attachment 10 into a standard handheld drill 12. A housing 20 on the shank 16 comprises a threaded end 22 and a hollow chamber 24. A compression bladder 26 having a tubular opening 28 through it is configured to be inserted into the hollow chamber 24. A tube 30 comprising a sanding or cleaning surface located on the inner surface of the tube 30 is configured to be insertable into the tubular opening 28 of the compression bladder 26. A threaded lid 32 having a circular opening 34 that is at least the same diameter as the inner diameter of the tube 30 is configured to mount onto the housing 20 at the threaded end 22.

Figure 3:
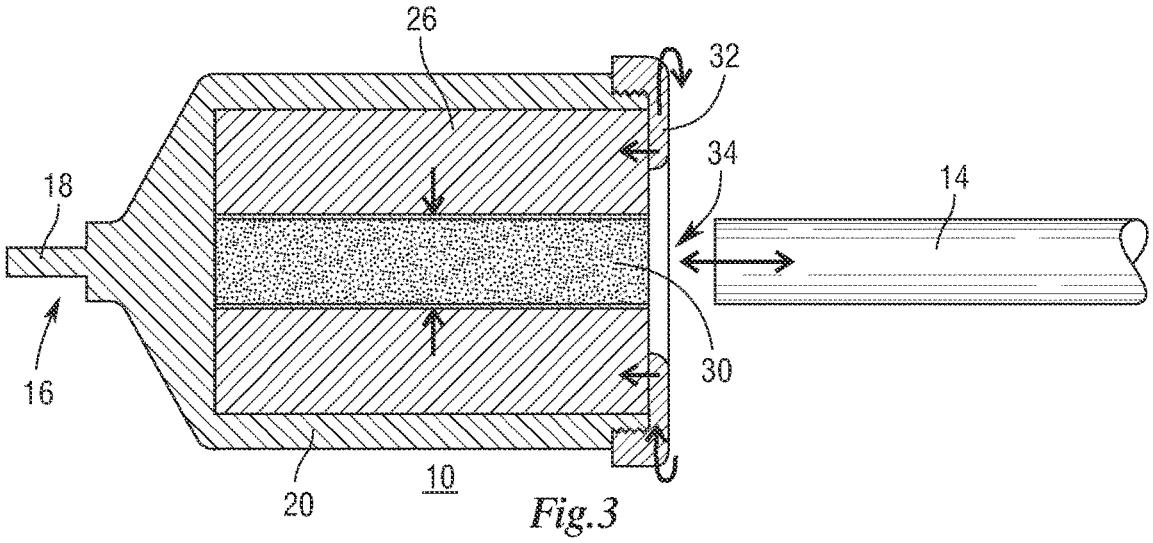
FIG. 3 is a cross-sectional view of the outer diameter cleaning and sanding drill attachment shown in FIG. 1.

As best understood by comparing FIGS. 2 and 3, as the lid 32 is screwed onto the threaded end 22 of the housing 20, the lid 32 compresses the compression bladder 26 thereby reducing the diameter of the tubular opening 28 and compressing the compression bladder 26 against the tube 30 to secure the tube 30 within the housing 20. This allows the tube 30 to be firmly held in place when the drill 12 is operated and a pipe 14 is inserted into the attachment 10. This allows the sanding surface of the tube 30 to sand or clean the outer diameter of the inserted pipe 14.

The housing 20, the tubular opening 28, and the tube 30 are of a length that limits the length of the end of the inserted pipe 16 that is able to be sanded/cleaned as it is inserted into the attachment 10. The compression bladder 26 is made of any compressible material that when compressed will reduce the diameter of the tubular opening 28. It is preferred that the compression bladder 26 is an elastomeric material such as rubber or a polymer plastic or a foam material.

Figure 4A:
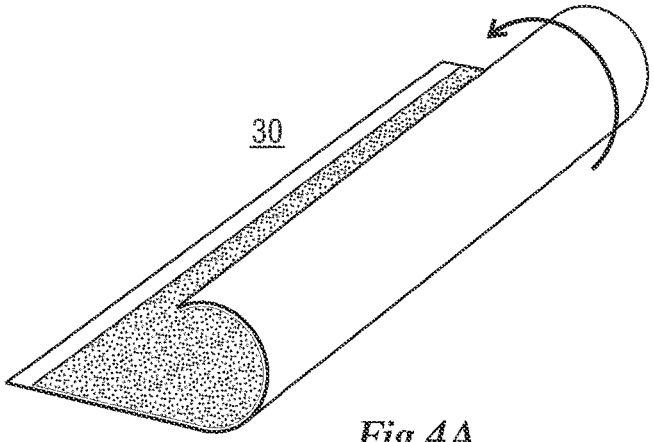
FIG. 4A shows how a tube is formed from a sheet of sanding paper.
Figure 4B:
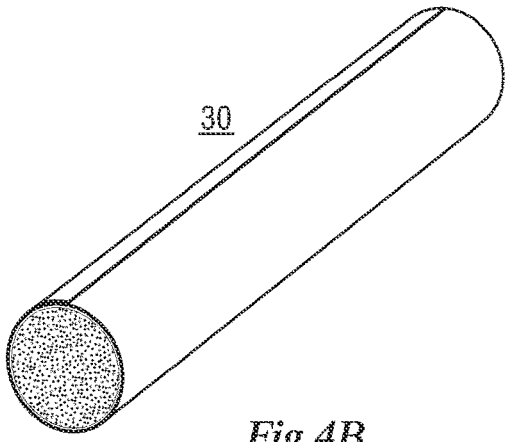
FIG. 4B shows a completely formed tube.

The tube 30 comprises a sanding or cleaning surface that may be one of emery cloth, sandpaper, glass paper, or any other kind of abrasive or cleaning material. The tube 30 is made of paper, plastic, or metal. As shown in FIGS. 4A and 4B, the tube 30 may be made of a paper or paperboard material that is rolled and secured by glue or other method to form the complete tube 30. The tube 30 may instead be manufactured to be an extruded metal or plastic tube with the appropriate cleaning or abrasive surface added. The tube 30 is sized to accept the insertion of pipes 14 into the attachment 10. The limitations on the size of pipe 14 to be accepted into the attachment 10 is the size of the circular opening 34 of the lid 32. For practical purposes, the circular opening 34 could have a diameter in the range of ¼-inch to 5-inches. Larger diameters would be possible but would likely make the drill 12 and attachment 10 unwieldy to handle and operate for small handheld drills but could be made of larger sizes for commercial and industrial applications. Correspondingly, the tube 30 would also have to have an inner diameter to accommodate the outer diameter of the pipes 14 to be cleaned/sanded and for practical purposes, the tubes could be sized to have an inner diameter in the range of ¼-inch to 5-inches, for small handheld drills but could be made of larger sizes for commercial and industrial applications so long as the compression bladder 26 has a tubular opening 28 that can accommodate the tube 30.

Figure 5:
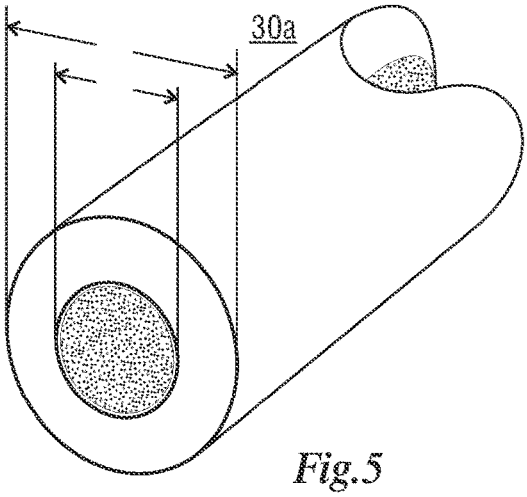
FIG. 5 is a view of a portion of another tube having a different wall thickness.
Figure 6:
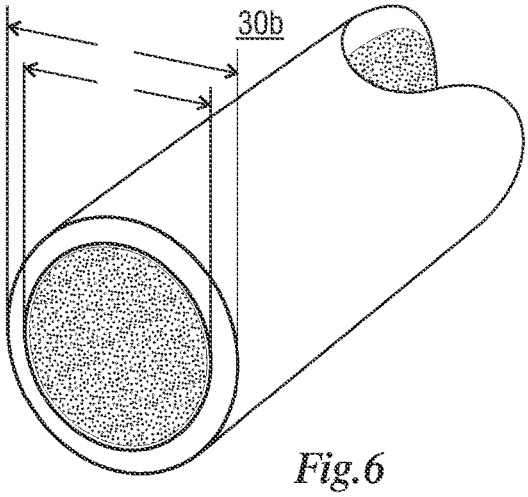
FIG. 6 is a view of a portion of another tube having a different wall thickness.

As shown in FIGS. 5 and 6, it is also possible to manufacture tubes 30*a*, 30*b* that have varying thicknesses. As best understood by comparing FIGS. 2, 5, and 6, it can be understood that that a tubular opening 28 of one size can accommodate a variety of tubes 30, 30*a*, 30*b* with different inner diameters to accommodate pipes of varying outer diameter. In this way a single attachment could be used to sand or clean pipes of varying outer diameter by merely changing out the tube 30, 30*a*, 30*b* to one of the appropriate inner diameter.

Alternatively, a user would have to swap out compression bladders that have differently sized tubular openings 28 with a tube 30 of the appropriate size. The limiting factor in this scenario would be the size of the circular opening 34 of the lid 32. Otherwise, the used would have to use larger attachments 10 with larger housings 20 that are able to accommodate lids 32 with larger circular openings 34, compression bladders 26 with larger tubular openings 28 and tubes 30 with larger inner diameters.

Figure 7:
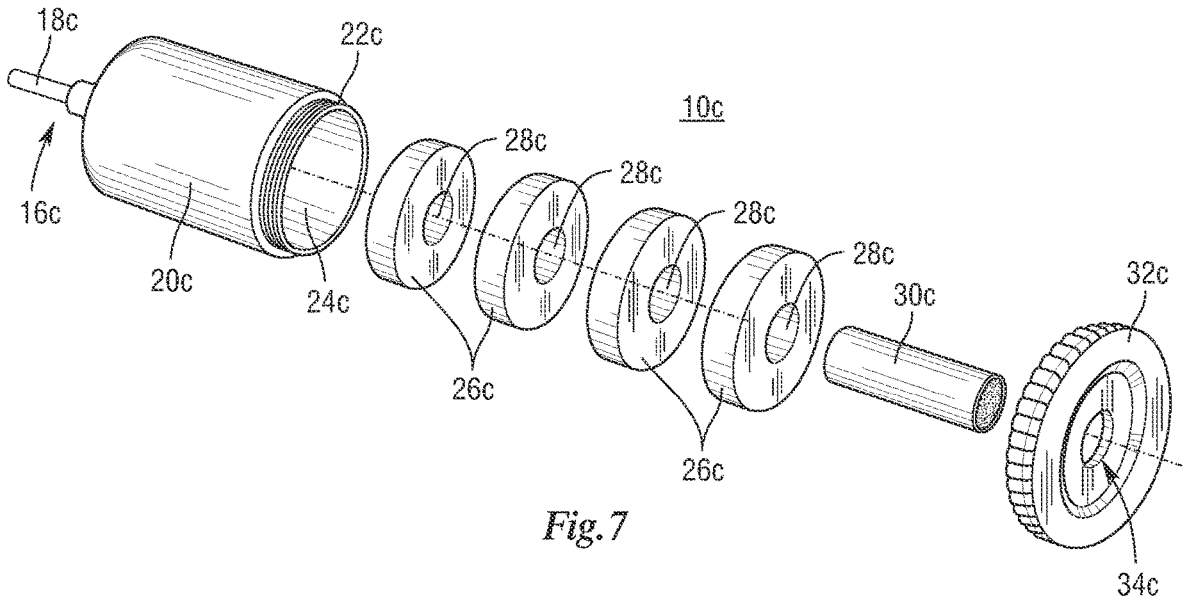
FIG. 7 is an exploded view of another embodiment of outer diameter cleaning and sanding drill attachment in which the compression bladder comprises a series of compression bladders.

FIG. 7 shows another embodiment of attachment 10*c* in which the attachment 10*c* comprises a shank 16*c* with a chuck 18*c* that is configured to mount the attachment 10*c* into a standard handheld drill. A housing 20*c* on the shank 16*c* comprises a threaded end 22*c* and a hollow chamber 24*c*. The compression bladder 26*c* in this embodiment is a series of compression bladders 26*c* that extend through said hollow chamber 24*c*. Each compression bladder 26*c* has a tubular opening 28*c* through it. The series of compression bladders 26*c* is configured to be inserted into the hollow chamber 24*c* and completely fills the attachment 10*c*. A tube 30*c* comprising a sanding or cleaning surface located on the inner surface of the tube 30*c* is configured to be insertable into the tubular openings 28*c* of the series of compression bladders 26*c*. A threaded lid 32*c* having a circular opening 34*c* that is at least the same diameter as the inner diameter of the tube 30*c* is configured to mount onto the housing 20*c* at the threaded end 22*c*.

The advantage to having a series of compression bladders 26*c* is that a user can use same compression bladders 26*c* in a variety of housings 20*c* of different length by the same diameter. So, if a longer length of tube needed to be sanded, an attachment 10*c* with a longer housing 20*c* could be used with the compression bladders 26*c* of different attachments.

In some embodiments, any one or more of the series of compression bladders 26*c* could be replaced with an incompressible ring in line with the compression bladders 26*c*. This could be done for costs reasons or to fill in empty space in a hollow chamber 24*c* for a housing 20*c* that maybe too long.

Figure 8:
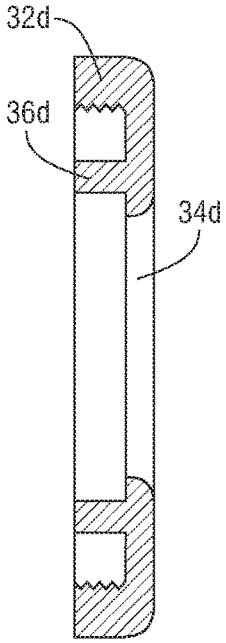
FIG. 8 is a cross-sectional view of an embodiment of lid that has a non-compressible ring mounted to it.

FIG. 8 shows a cross section of an embodiment of lid 32*d* in which a non-compressible ring 36*d* is mounted to the lid 32*d*. The non-compressible ring 36*d* is located between the lid 32*d* and the compression bladder and assists in pushing the compression bladder into the housing of the attachment. The non-compressible ring 36*d* in this embodiment is formed into the lid 32*d* but it could be a separate piece that it free floating or attached to the lid with clips or other means. The non-compressible ring could also limit the size of the circular opening 34*d* if additional support were to be required to compress the compression bladder.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. An attachment for a drill that comprises:

a shank with a chuck configured to mount the attachment to the drill;

a housing on the shank;

said housing comprising a threaded end and a hollow chamber;

a compression bladder having a tubular opening through said compression bladder wherein said compression bladder comprises a material that is compressible and expandible such that when compressed, reduces said opening thereby locking an object within said opening;

said compression bladder configured to be inserted into said hollow chamber;

a tube comprising a sanding or cleaning surface located on the inner surface of said tube;

said tube is configured to be insertable into said tubular opening of said compression bladder wherein said tube is said object locked within said opening;

a threaded lid having a circular opening, said circular opening is at least the same diameter as the inner diameter of said tube, said lid is configured to mount onto said housing at said threaded end and compress said compression bladder thereby reducing the diameter of the tubular opening and compressing said compression bladder against said tube to secure said tube within said housing.

2. The attachment of claim 1 further comprising said compression bladder comprises a series of compression bladders that extend through said hollow chamber.

3. The attachment of claim 1 further comprising at least one non-compressible ring in line with said compression bladder.

4. The attachment of claim 1 further comprising said lid further comprises a non-compressible ring mounted between said lid and said compression bladder.

5. The attachment of claim 1 further comprising said compression bladder is an elastomeric material.

6. The attachment of claim 1 further comprising said tube is made of paper, plastic, or metal.

7. The attachment of claim 1 further comprising said sanding or cleaning surface comprises one of emery cloth, sandpaper, and glass paper.

8. The attachment of claim 1 further comprising said tube has an inner diameter in the range of ¼-inch to 5-inches.

9. The attachment of claim 1 further comprising said circular opening has a diameter of in the range of ¼-inch to 5-inches.

* * * * *